United States Patent [19]

Brocklebank et al.

[11] Patent Number: 4,679,336

[45] Date of Patent: Jul. 14, 1987

[54] EARTH MOVING MACHINE

[75] Inventors: Norman Brocklebank, Beverley; Alan Cooper, Stoke on Trent, both of United Kingdom

[73] Assignee: J. C. Bamford Excavators Limited, Rocester, United Kingdom

[21] Appl. No.: 802,719

[22] Filed: Nov. 27, 1985

[30] Foreign Application Priority Data

Dec. 1, 1984 [GB] United Kingdom ..... 8430389

[51] Int. Cl.[4] ..... E02F 5/02

[52] U.S. Cl. ..... 37/103; 414/694; 414/719; 414/695.5; 212/197

[58] Field of Search ..... 37/103, 115, 116, DIG. 1, 37/DIG. 7, DIG. 9; 414/719, 694–695.6; 212/196–198

[56] References Cited

U.S. PATENT DOCUMENTS

| | | | |
|---|---|---|---|
| 1,718,434 | 6/1929 | Ronk . | |
| 2,022,808 | 12/1935 | Kerr | 414/694 |
| 2,639,826 | 5/1953 | Welden | 414/732 |
| 2,763,385 | 9/1956 | Harrison . | |
| 3,279,632 | 10/1966 | Kramlich | 414/694 |
| 3,891,095 | 6/1975 | Symmank | 212/197 |
| 3,902,735 | 9/1975 | Bertram | 212/197 |
| 3,924,753 | 12/1975 | Lamer et al. | 414/719 |
| 3,938,669 | 2/1976 | Vinton | 414/719 X |
| 3,945,518 | 3/1976 | Inoue | 414/719 |
| 3,963,132 | 6/1976 | Dufour | 414/719 |
| 4,494,906 | 1/1985 | Brocklebank | 414/719 |

FOREIGN PATENT DOCUMENTS

| | | | |
|---|---|---|---|
| 1008407 | 4/1977 | Canada . | |
| 33060 | 8/1981 | European Pat. Off. . | |
| 0077684 | 10/1982 | European Pat. Off. . | |
| 1233337 | 1/1967 | Fed. Rep. of Germany . | |
| 2602898 | 1/1976 | Fed. Rep. of Germany . | |
| 1154723 | 6/1956 | France | 212/196 |
| 2447488 | 1/1980 | France . | |
| 83/00037 | 6/1982 | PCT Int'l Appl . | |
| 1020635 | 2/1966 | United Kingdom | 212/198 |
| 1110475 | 4/1968 | United Kingdom . | |
| 1222797 | 3/1969 | United Kingdom . | |
| 1463952 | 1/1975 | United Kingdom . | |
| 2014109 | 1/1979 | United Kingdom . | |
| 2159122 | 11/1985 | United Kingdom | 212/196 |

*Primary Examiner*—E. H. Eickholt

*Attorney, Agent, or Firm*—Robert C. Baker

[57] ABSTRACT

A machine comprises a body (10) having a ground engaging propulsion means (11) and a base frame (14) mounted on the ground engaging means (11), the base frame (14) being movable relative to the ground engaging propulsion means (11) about a first generally vertical axis (V), a boom (30) extending outwardly of the body (10) and mounted on the base frame (14) for movement about a second axis (B) transverse relative to the first axis (V), the boom (30) having mounted at an outer end (36) thereof for movement about a third axis (71) also transverse to the first vertical axis (V), a dipper arm (37), an implement (43) mounted at an outer end (42) of the dipper arm (37) for movement about a fourth axis (T2), also generally transverse relative to the vertical axis (41), a cable (47) secured to the dipper arm (37) and connected to a winch means (50) to effect movement of the dipper arm (37) relative to the boom (30) to effect movement of the implement (43) towards the body (10), a hydraulic ram (38) mounted between the dipper arm (37) and the boom (30) to effect movement of the dipper arm (37) relative to the boom (30) and hence to effect movement of the implement (43) at least away from the body (10), and a counterweight (20*a*), mounted on the base frame (14), means being provided to move the counterweight (20*a*), towards and away from the first vertical axis (41) in response to movement of the center of gravity of the machine (10).

14 Claims, 5 Drawing Figures

EARTH MOVING MACHINE

BACKGROUND OF THE INVENTION

This invention relates to a machine such as an earth moving machine, that is a machine having a body movable by its own propulsion means over the ground, and a boom mounted on the body, the boom and/or an additional arm mounted thereon, known commonly as a "dipper" arm, carrying an implement such as a bucket or other excavating implement, forks or any other implement for handling loads, the body and/or the boom and/or dipper arm and/or implement being relatively movable to enable operations to be carried out, such as earth moving, by the implement.

In recent years, there has been a need for an earth moving machine having long reach, that is the implement has to be able to carry out operations at a considerable distance from the body of the machine. Whereas the use of hydraulic rams in earth moving machines is well known for achieving relative movement between the body and/or the boom and/or the dipper arm and/or the implement, hydraulic rams are not operationally satisfactory where very large leverages are encountered, e.g. when the boom and/or dipper arm are long and the implement is a considerable distance from the body.

Hence, it has been proposed to use a cable and winch arrangement, to move the implement towards the body during an operation. Such an arrangement is shown in European specification EP 0077684. The machine disclosed in this specification is also provided with a counterweight which is slidable along the boom to vary the counterbalance of the machine as the implement is moved towards and away from the body.

The machine has a counterweight and a dipper arm ram both mounted on the boom, the dipper ram moving the counterweight along the boom to cause the dipper arm to pivot outwardly by means of a cable which is attached at one end to the counterweight and at the other end to the dipper arm.

The cable is thus economically used both for moving the counterweight to balance the machine and to enable the dipper arm to be pivoted out, with minimum stress and strain on the remainder of the boom structure.

However, such a machine also has disadvantages.

First, in this prior machine, a further cable is used with a winch means for moving the implement towards the body in addition to the cable which allows for automatic adjustment of the position of the counterweight in response to movement of the implement. So many cables are undesirable.

Secondly, the counterweight, by being mounted on the boom, is very high above the ground and this can lead to lateral instability of the machine during operation.

Thirdly, the boom is mounted intermediate its ends on the body so as to provide a tail part which extends rearwardly of the mounting, on which the counterweight slides. Because part of the boom extends behind the mounting, the angle through which the boom can pivot relative to the body about a generally horizontal axis, is restricted and hence the working range of the implement is restricted.

Fourthly, the boom in the arrangement of European specification EP 0077684 must necessarily be straight because of the cable which runs along the top of the boom and is connected to the dipper arm and counterweight.

It is desirable to be able to provide a cranked or curved boom where less loading height is needed but greater depth access is required. If a curved boom were used in the arrangement of European specification EP 0077684, pulleys and the like would be required to guide the cable, and this would result in premature wear of the cable and this would be unsatisfactory in practice.

The body of the machine is only satisfactorily suited to receiving booms and dipper arm arrangements adapted for long reach operation and if it is required to exchange the long reach boom and dipper arm arrangement for a conventional shorter reach arrangement, for example having a hydraulic ram which is effective to move the dipper arm both towards and away from the body, the part of the boom which extends rearwardly of the mounting has to be retained, where a counterweight is required, thus severely restricting the working range of the implement.

Accordingly, it is an object of the present invention to provide a new or improved machine which overcomes these disadvantages and provides additional advantages.

SUMMARY OF THE INVENTION

According to one aspect of the present invention, we provide a machine comprising a body having a ground engaging propulsion means and a base frame mounted on the ground engaging propulsion means, the base frame being movable relative to the ground engaging propulsion means about a first generally vertical axis, a boom extending outwardly of the body and mounted on the base frame for movement about a second axis transverse relative to the first axis, the boom having mounted at an outer end thereof for movement about a third axis also transverse to the first vertical axis, a dipper arm, an implement mounted at an outer end of the dipper arm for movement about a fourth axis, also generally transverse relative to the vertical axis, a cable secured to the dipper arm and connected to a winch means to effect movement of the dipper arm relative to the boom to effect movement of the implement towards the body, characterised in that a hydraulic ram is mounted between the dipper arm and the boom to effect movement of the dipper arm relative to the boom, and hence to effect movement of the implement at least away from the body, and a counterweight is mounted on the base frame, means being provided to move the counterweight towards and away from the first vertical axis in response to movement of the centre of gravity of the machine.

Thus the disavantages associated with the machine described in European specification EP 0077684 are substantially overcome. The cable which is secured at one end to the dipper arm and connected to the winch means to effect movement of the implement towards the body, need only be used for moving the implement towards the body, whereas the hydraulic ram between the dipper arm and the boom would be used to effect movement of the implement away from the body and so the number of cables required is reduced and no significant strain is imposed on the hydraulic ram as the dipper arm is moved towards the body. Where the implement is an excavating implement such as a bucket, it will be appreciated that the bucket is filled as the bucket is moved towards the machine under the action of the winch means. The hydraulic ram is thus only used when the lesser effort is required to move the dipper arm and hence the implement outwardly.

For shorter reach, the machine can be provided with a conventional short reach boom and dipper arm arrangement in which movement of the implement towards and away from the body can be achieved by operation of a hydraulic ram and the counterweight can be retained. However such a machine is outside the scope of the present invention.

In a machine in accordance with the present invention, because the counterweight is mounted on the base frame and not on the boom, the stability of the machine is increased, compared with the arrangement of European specification EP 0077684. Further, no part of the boom has to extend significantly rearwardly of the boom mounting to accommodate the counterweight, so that greater movement of the boom about the second axis is permitted.

Further, because the counterweight is mounted on the base frame, and not for sliding along the boom as in European specification EP 0077684, the boom may be mounted adjacent its end so that a more compact body design is possible.

Preferably the movement of the counterweight is along an axis generally perpendicular to the first vertical axis. Thus the centre of gravity of the machine does not change vertically due to movement of the counterweight whereas in the arrangement of European specification EP 0077684 the counterweight has to slide up and down an inclined plane provided by the tail of the boom, for most boom positions.

Preferably an operator's cab is mounted on the base frame for example on one side thereof, from which an operator may control the operation of the hydraulic ram and the winch means, to enable the operator to control movement of the implement towards and away from the body, from within the operator's cab.

The winch means is preferably mounted on the boom, but could be mounted on the body if required. The winch means may comprise a hydraulic motor, an electric motor or any other power means which releases the cable as the implement moves away from the body under the power of the hydraulic ram.

Fluid from the hydraulic ram may be returned to a hydraulic reservoir mounted in or on the body of the machine, as the implement is moved towards the body to the cable and winch means.

In a preferred arrangement, the counterweight moves on the base frame in response to movement of the dipper arm relative to the boom, which movement of the dipper arm will result in a change in the position of the centre of gravity of the machine.

In one embodiment, a sensor is provided to sense any change in relative position between the dipper arm and the boom, the sensor sending a signal to an operating member which moves the counterweight towards or away from the first vertical axis of the machine in proportion to the degree of movement of the dipper arm relative to the boom.

The sensor may comprise an hydraulic sensor, the signal comprising the passage of hydraulic fluid from the sensor towards the operating member which moves the counterweight.

The sensor may comprise a hydraulic ram mounted interiorly of the dipper arm, the plunger or cylinder of the sensor ram being connected to an extension of the boom and the plunger or cylinder of the sensor ram being fixed relative to the dipper arm.

Preferably, a further hydraulic ram is provided to permit movement of the boom relative to the body about the second axis which may be generally horizontal and the hydraulic sensor senses changes in pressure within the further hydraulic ram caused by movement of the dipper arm relative to the boom and the magnitude of the load, if any, carried by the implement.

The operating member may comprise a further hydraulic ram, movement of a plunger of the further hydraulic ram being proportional to the signal received from the sensor.

Alternatively and preferably, the operating member comprises a hydraulic motor which is operatively connected to a lead screw, the screw being fixed relative to the counterweight such that as the screw is rotated by the hydraulic motor in response to the signal, the counterweight is moved towards or away from the first axis.

Preferably, the boom is mounted adjacent its end to the body of the machine, so that no significant part of the boom extends rearwardly of the mounting.

The boom may comprise a single boom part which may be cranked or curved intermediate its ends, to permit the implement to reach to a maximum depth when the boom is in its lowest position, or alternatively, the boom may comprise two or more boom parts. For example, the boom may have a base part secured to the body of the machine and a further part slidable or otherwise movable relative to the base part.

The ground engaging propulsion means preferably comprises two or more endless tracks which may be driven from an engine via a suitable transmission. Alternatively, the ground engaging propulsion means may comprise a chassis having two or more pairs of wheels to enable the body to move relative to the ground. Any other propulsion means may be provided as required.

The base frame may be secured to one part of a slewing ring, and another part of the slewing ring may be secured to the ground engaging propulsion means, the two slewing ring parts being relatively rotatable to permit the base frame to rotate relative to the ground engaging propulsion means about said first vertical axis. Alternatively, any other means to cause the base frame to rotate relative to the ground engaging propulsion means may be provided.

The machine may comprise an earth moving machine, in which case the implement may comprise an excavating implement such as a bucket, mounted on the dipper arm, such that the implement is filled as the implement is moved towards the body of the machine.

The second, third and fourth axes may each be generally perpendicular to the first axis.

BRIEF DESCRIPTION OF THE DRAWINGS

The invention will now be described with the aid of the accompanying drawings, wherein.

DETAILED DESCRIPTION OF THE PREFERRED EMBODIMENTS

Figure 1:
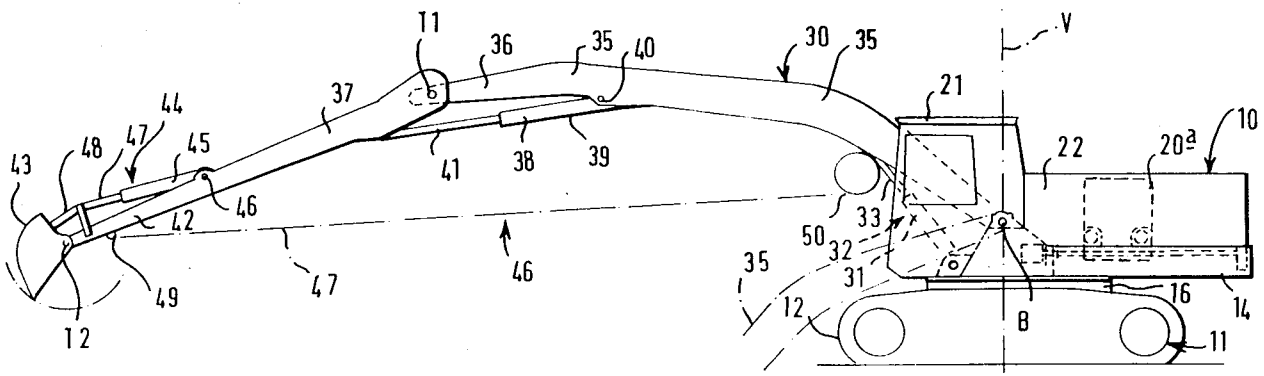
FIG. 1 is a side elevation of an earth moving machine in accordance with the invention.
Figure 2:
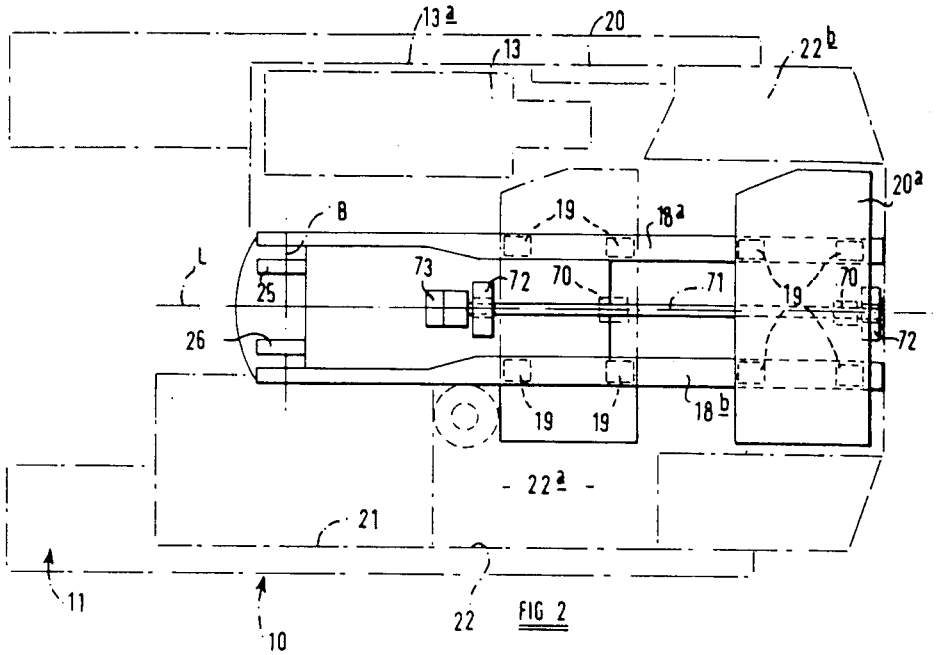
FIG. 2 is a plan view of an upper body part of the earth moving machine of FIG. 1, with the boom omitted and a housing broken away for clarity showing the counterweight in full lines in an extended position and in chain dotted lines in a retracted position.

Referring first to FIGS. 1 and 2, an earth moving machine comprises a body 10 including a lower body part comprising a ground engaging propulsion means 11 which, in the present example, comprises a pair of endless tracks 12 driven via a suitable transmission from an engine, the position of the engine being shown diagrammatically at 13 in FIG. 2. Of course, if desired, two or more pairs of wheels may be provided on a chassis or any other ground engaging propulsion means may be provided as required.

Mounted on the ground engaging propulsion means 11 for movement about a first vertical axis V, is an upper body part comprising a base frame 14, the base frame 14 being secured to one part of a conventional slewing ring 16 and another part of the ring 16 which is rotated relative to the one part, being secured to the ground engaging propulsion means 11.

Mounted on the body 10 either side of a longitudinal axis L of the base frame 14 are a pair of longitudinal members 18*a*.

The members 18*a*, 18*b*, together provide a guide path for a movable counterweight 20*a*, contained within a housing 20 of the upper body part mounted on the base frame 14, the operation of which is described in detail hereinafter.

Also mounted on the base frame 14 on one side thereof is an operator's cab 21 and superstructure 22, which superstructure 22 provides a space 22*a* for components such as valves and the like of a hydraulic system of the machine.

The engine 13 is housed in another superstructure 13*a* on the opposite side of the machine to the cab 21 and superstructure 22.

Centrally mounted on the base frame 14, are two lugs 25, 26, which together provide a support for a boom ram 32. A cylinder part 31 of the hydraulic ram 32 is mounted for pivotal movement on the base frame 14, which ram 32 is provided to effect movement of a boom 30 about a second generally horizontal boom axis B. A plunger 33 of the ram 32 is secured, again for pivotal movement, to the boom 30.

It can be seen that the boom 30 extends outwardly of the body 10 a considerable distance and is curved or cranked such as indicated at 35 so that when the boom 30 is in a lowered position, which is indicated in dotted lines in FIG. 1, maximum depth can be reached.

At an outer end 36 of the boom 30, a dipper arm 37 is mounted for movement relative to the boom 30 about a third axis $T_1$ transverse i.e. generally perpendicular to vertical axis V. To effect movement of the dipper arm 37 relative to the boom 30, a hydraulic ram 38 is provided, a cylinder part 39 of which is pivotally secured to the boom 30 as shown at 40, and plunger 41 of which is pivotally secured to dipper arm 37. However, the ram 38 is only used to effect movement of the dipper arm 37 in a clockwise sense, as seen in FIG. 1, i.e. outwardly relative to the body 10 of the machine, other means being provided to effect anti-clockwise movement. At the outer end 42 of the dipper arm 37 an excavating implement comprising, in this instance, a bucket 43 is mounted for pivotal movement relative to the dipper arm 37 about a fourth axis $T_2$, again transverse i.e. generally perpendicular to the vertical axis V of the machine.

To effect pivotal movement of the implement 43, another hydraulic ram 44 is provided, a cylinder part 45 of which is secured in pivotal manner to the dipper arm 37 as shown at 46, and a plunger 47 of which is secured in pivotal manner via a linkage 48 to the bucket 43. Of course, if desired any other suitable excavating or other implement may be mounted on the end 42 of dipper arm 37 in place of the bucket 43, and movement of the implement relative to the dipper arm 37 could be achieved by connecting hydraulic ram 44 to the implement and dipper arm 37 in any other manner.

The hydraulic rams 32, 38 and 44 are each supplied with hydraulic fluid under pressure from one or more pumps via suitable pipes, including flexible pipes where necessary, as is well known in the art. The rams 32, 38 and 44 are each controlled from within the operator's cab 21 mounted on the base frame 14, so that an operator has complete control over operation of the boom 30, dipper arm 37 and implement 43.

As mentioned above, movement of the dipper arm 37 relative to the boom is only effected in a clockwise sense by hydraulic ram 38. To effect anti-clockwise movement of the dipper arm, to move the bucket 43 towards the body 10 of the machine, a cable arrangement 46 is provided. One end of a cable 47 is secured, as shown at 49, to the dipper arm 37 at a position adjacent to the bucket 43. The other end of cable 47 is received by a winch means 50 comprising a drum driven by a a further hydraulic motor.

The winch means 50 is, as shown, mounted on the boom 30, but could instead be mounted on the body 10 if required.

When it is required to move the bucket 43 away from the body 10, the hydraulic ram 38 is actuated, the plunger 41 being urged from the cylinder part 39. In this event, the hydraulic motor of the winch means 50 will be inoperative so that the cable 47 will be permitted to unwind as hereinafter described. When it is required to move the bucket 43 towards the base frame 14, the winch motor is operated to wind in the cable 47, and fluid urged from the cylinder part 39 of ram 38 is allowed to flow to a hydraulic reservoir, which may be positioned in space 22*b* shown in FIG. 2.

Preferably, ram 38 and winch means 50 are controlled from a single lever within the operator's cab 21. Movement of the lever in one direction operating ram 38 to move the bucket 43 away from the body 10, and movement of the lever in an opposite direction operating the winch means 50 to move the bucket 43 inwardly. However, other control arrangements are possible.

It will be appreciated that as the boom 30 and dipper arm 37 extend a long way from the base frame 14, as the bucket 43 moves towards and away from the base frame, considerable changes in the centre of gravity of the base frame 14 and ground engaging propulsion means 11 will be caused. To counter this, the counterweight 20*a*, is mounted, as hereinbefore described, for movement towards and away from vertical axis V.

The counterweight 20*a*, is made of cast iron. In FIG. 1, the counterweight 20*a*, is shown in an extended position furthest from axis V, as the implement 43 is furthest from the body 10. The counterweight 20*a*, is also shown in an extended position in FIG. 2, in full lines, and a retracted position in chain dotted lines.

The counterweight 20*a*, has rollers 19 which roll on the longitudinal members 18*a*,18*b*, and a captive nut 70. The captive nut 70 receives a lead screw 71 which is also received in bearings 72 mounted on the base frame 14. The lead screw 71 is adapted to be rotated by a reversible hydraulic motor 73.

The motor 73 is operated under the control of a control means described hereinafter with reference to FIG. 3, such that when the centre of gravity of the machine shifts forwardly in the direction of boom extension, for example as the dipper arm 37 and hence implement 43 are moved outwardly relative to the body 10 of the machine by ram 38, the counterweight 20*a*, is moved outwardly away from axis V by virtue of the lead screw 71 rotating within the captive nut 70, to counterbalance the machine.

Conversely, when the centre of gravity shifts in the opposite direction, for example as the dipper arm 37 and hence implement 43 is moved inwardly relative to the body 10 of the machine by the winch and cable arrangement 46, the counterweight 20*a*, is moved inwardly towards axis V, again by virtue of lead screw 71 rotating, but in an opposite direction, within the captive nut 70.

Figure 3:
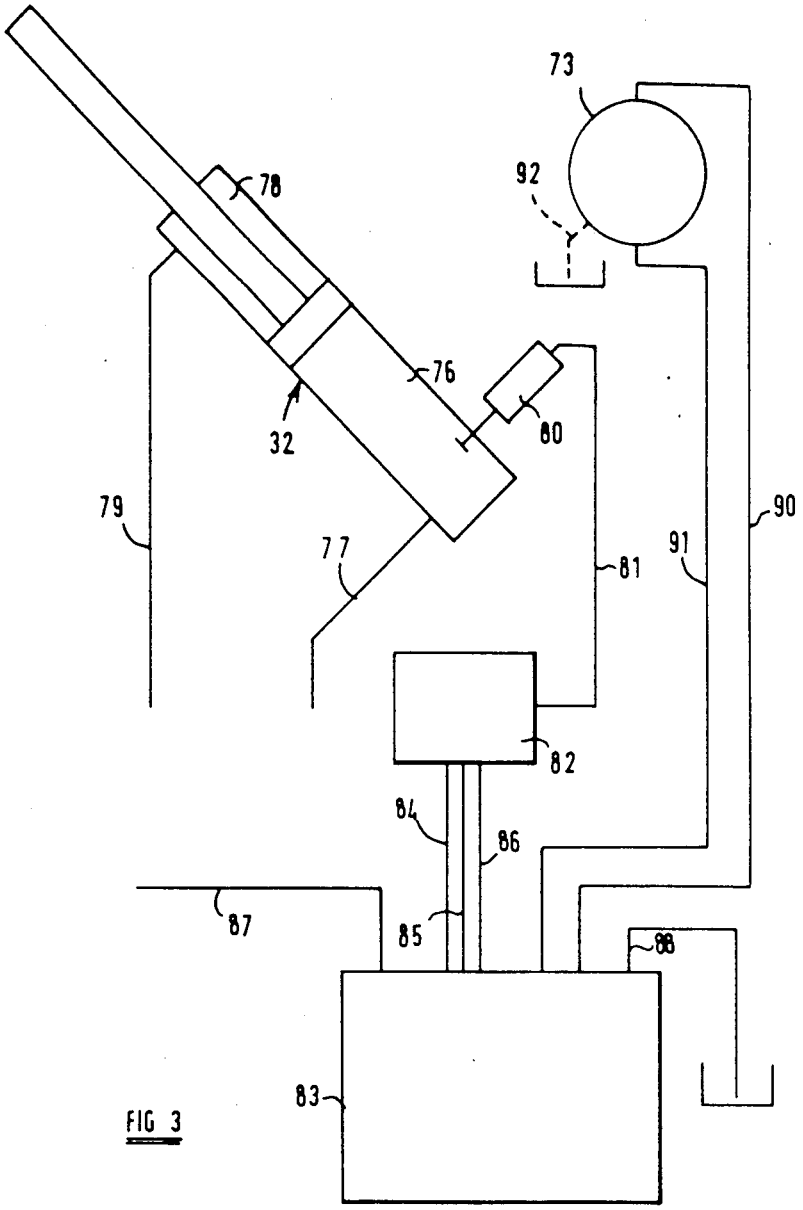
FIG. 3 is a diagrammatic representation of part of the hydraulic system of the earth moving machine of FIGS. 1 and 2.

Referring now to FIG. 3, part of the hydraulic system of the machine is shown diagrammatically.

When the boom 30 is moved clockwise as hereinbefore described, fluid is fed under pressure to the non-annulus side 76 of the boom ram 32 along a hydraulic line 77, under the control of control valves operable from within the operator's cab 21. Conversely when the boom 30 is moved anti-clockwise, as hereinbefore described, fluid is fed under pressure to the annulus side 78 of ram 32 along line 79.

Such an arrangement is well known in the art and detailed description of the operation of the ram 32 is not deemed necessary.

A hydraulic sensor 80 is provided to sense the hydraulic pressure in the non-annulus side 76 of the ram 32, which sensor 80 sends a signal i.e. hydraulic fluid, along a line 81 to a receiver 82 which smooths the signal from sensor 80 and provides a command to a control unit 83 via control lines 84,85,86.

The control unit 83 receives hydraulic fluid under pressure along line 87 and has an outlet 88 to the hydraulic fluid reservoir.

When the sensor 80 senses an increase in pressure in the non-annulus side 76 of ram 32, the receiver 82 sends a signal to control unit 83 to open a spool valve within the unit so that hydraulic fluid from the supply 87 flows to the hydraulic motor 73 via line 90.

Such an increase in pressure would occur, for example if the dipper arm 37 is moved outwardly, which would cause the centre of gravity of the machine to move forwardly. The motor 73 is thus arranged to operate to rotate the lead screw 71 to move the counterweight 20*a*, away from the axis V to counterbalance the machine.

When sensor 80 senses a decrease in pressure, the receiver 82 sends a signal to control unit so that fluid is fed to the motor 73 along line 91 which causes the motor 73 to operate in an opposite direction, so that the counterweight 20*a*, is moved towards the axis V. Such a decrease in pressure in the non-annulus side 76 of ram 32 could occur, for example, as the dipper arm 37 is moved inwardly towards the body 10 of the machine. The motor 73 has an outlet 92 to the hydraulic fluid reservoir to enable fluid which is pumped to the motor 73, for example when the counterweight 20*a*, is at the end of its travel, can be discharged to the reservoir.

It will be appreciated that any movement of the boom 30 relative to the body 10, especially of the dipper arm 37 relative to the boom 30 will shift the centre of gravity of the machine and this shift will be sensed by the hydraulic sensor 80 which will provide a signal to an operating member which moves the counterweight 20*a*, the operating member in this example comprising the hydraulic motor 73.

Any other type of hydraulic sensor could be used, such as that shown in FIG. 5 hereinafter described, and any other type of operating member to move the counterweight 20*a*, could be used, an alternative again being shown in FIG. 5.

However, if desired any other means for causing the counterweight 20*a*, to move towards or away from the vertical axis V of the machine in response to shifts in the centre of gravity of the machine could be provided. Instead of a hydraulic motor 73, an electric motor could be provided and instead of the lead screw arrangement 71, any other suitable operating means for moving the counterweight could be employed.

Figure 4:
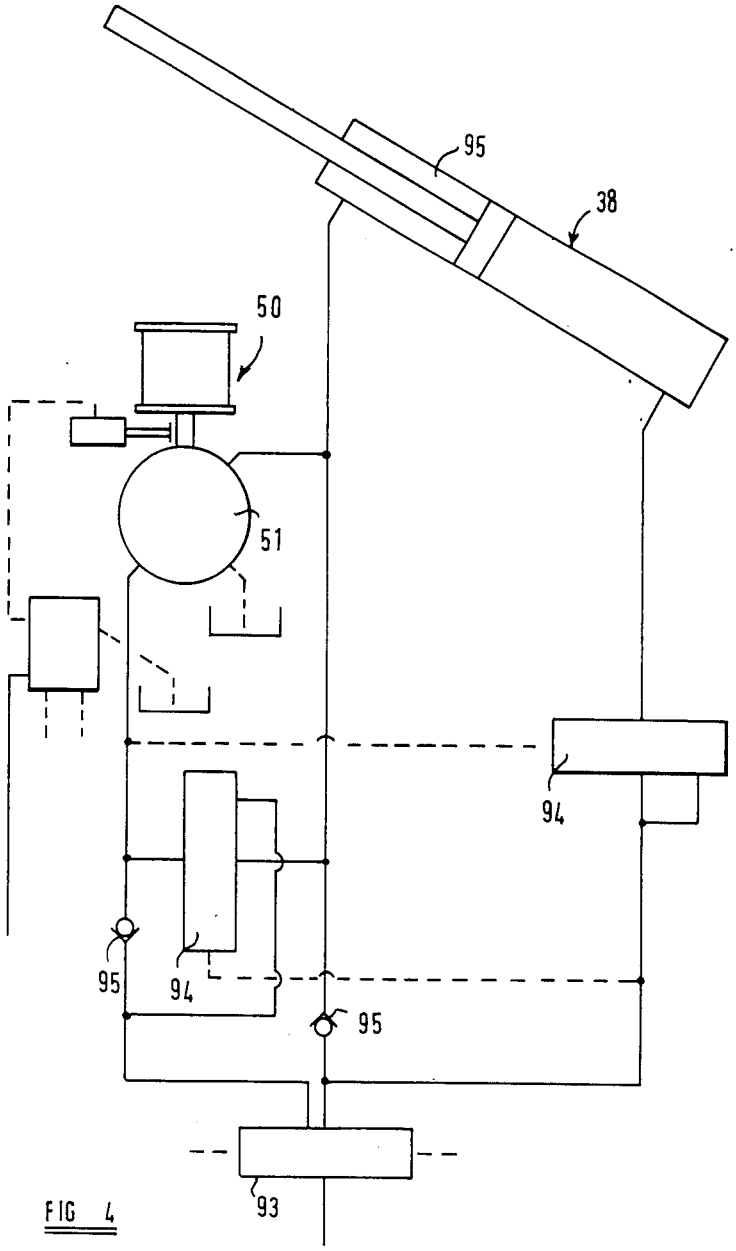
FIG. 4 is diagrammatic representation of another part of the hydraulic system.

Referring briefly to FIG. 4, another part of the hydraulic circuit is shown diagrammatically.

The dipper ram 38 which is arranged to move the dipper arm 37 outwardly only, is connected hydraulically to the winch 50 which is driven by another hydraulic motor 51, such that the ram 38 and motor 51 cannot be operated together. Both are operated from a common main spool valve 93 and counterbalance valves 94, and check valves 95 are provided to prevent either fluid being fed to the ram 38 when the winch motor 51 is operative, or vice versa. However, fluid may flow freely from annulus side 95 of ram 38 when the motor 51 is operated, and the winch 50 can freely release the cable 47 when the ram 38 is operated.

Figure 5:
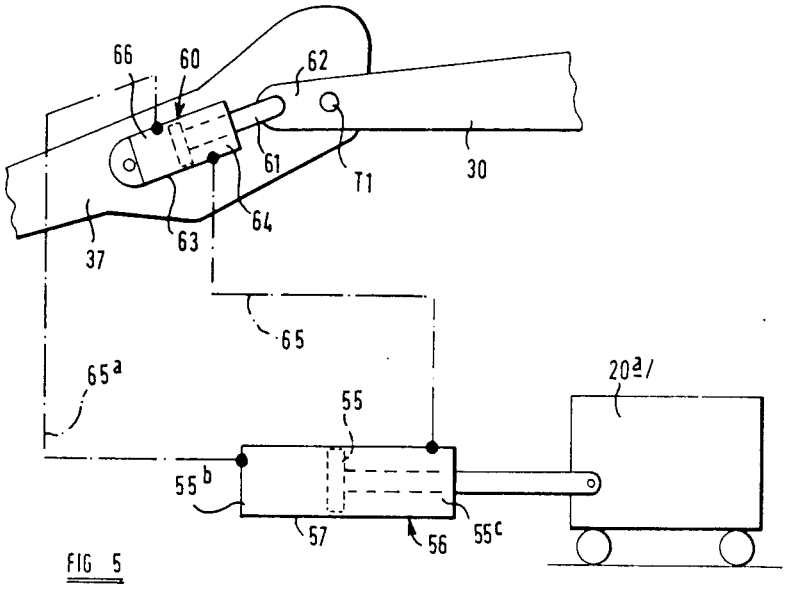
FIG. 5 is a diagrammatic representation of part of the hydraulic system of a modified machine in accordance with the invention.

Referring now to FIG. 5, an alternative arrangement is shown for a modified machine. Instead of a motor 73 and lead screw 71 secured to counterweight 20*a*, is a plunger 55 of a further hydraulic ram 56, a cylinder part 57 of which is secured to the base frame 14. As hydraulic pressure is increased in the cylinder part 57 in a non-annulus region 55*b*, the counterweight 20*a*, will thus be moved away from vertical axis V of the machine. Conversely, where hydraulic pressure in the cylinder part 57 in the annulus region 55*c* of the cylinder 57 is increased, the plunger 55 will be urged inwardly of the cylinder part 57 to thereby move the counterweight 20*a*towards the vertical axis V.

The position of the counterweight 20*a* is controlled automatically by means of a still further hydraulic ram 60 which is mounted between dipper arm 37 and boom 30 interiorly of the dipper arm 37. A plunger 61 of the ram 60 is pivotally secured to an extension 62 of the boom 30, whilst a cylinder part 63 thereof is secured firmly to the dipper arm 37. The mounting of the plunger 61 on the boom 30 permits of pivotal movement, and the mounting of the cylinder part 63 interiorly of the dipper arm 37 also permits such movement.

It will be appreciated therefore that as ram 38 is operated to move the bucket 43 outwardly, or as to winch means 50 is operated to move the bucket 43 inwardly, the plunger 61 of ram 60 will be urged inwardly or outwardly of its cylinder 63 a corresponding amount.

Annulus region 64 of the cylinder part 63 or ram 60 is connected via a hydraulic line 65 to annulus region 55*c* of the ram 56. Thus, as fluid is urged from region 64 of the cylinder part 63 as the bucket 43 moves towards the body 10, fluid will be injected into the cylinder part 55*c* of the ram 56 to urge the plunger 55 inwardly. Thus the counterweight 20*a*, will be moved towards the axis V. Conversely, as fluid is urged from region 66 of the ram 60 as the bucket 43 moves away from the body 10, this fluid will be transmitted via a further hydraulic line 65*a* to behind the plunger 55 of ram 56 to urge the plunger 55 outwardly of the ram 56, and hence move the counterweight 20*a* away from the axis V.

The hydraulic system is a closed system so that no fluid is added to or lost from the system during operation, so that movement of plunger 55 is always proportional to the movement of plunger 61 and hence movement of the counterweight 20*c* is proportional to the relative movement between the dipper arm 37 and boom 30.

By arranging for specific relative sizes of rams 56 and 60, a desired inward or outward movement of the counterweight 20*a*, can thus be achieved for a given movement of the bucket 43 towards or away from the body 10, automatically. Thus the stability of the machine 10 is maintained as the bucket 43 is moved.

The machines described have at least the following other advantages over the earth moving machine known for European specification EP 0077684 namely:

1. The centre of gravity of the machine can be very low to further reduce instability;

2. The boom 30 may be mounted adjacent its end for movement about a generally horizontal boom axis B so that no substantial part of the boom needs to project for any distance behind axis B. This permits of maximum angular movement of boom about axis B and hence the implement can operate through a maximum working range.

3. The boom 30 may be cranked or curved as described at 35 to permit maximum depth of reach when the boom 30 is in its lowermost position.

Various modifications may be made to the machines described without departing from the scope of the invention. For example, it is not essential for the hydraulic rams 32, 38, 44, to be mounted as described, but alternative arrangements are possible.

The sensor ram 60 as described with reference to FIG. 5 is mounted interiorly of the dipper arm 37, but could of course be mounted exteriorly thereof or even within the boom as required. Further, if desired, with suitable hydraulic circuitry, a proportion of the fluid fed to or from hydraulic ram 38 may be used to provide a signal to an operating member to move the counterweight 20*a*, towards or away from vertical axis V as required proportional amount.

The long reach boom 30 need not be cranked as described at 35, where the additional low depth advantage is not required, but the boom 30 could be straight.

In place of a hydraulic motor to operate the switch means 50, if desired an electrical motor or any other power means may be provided to wind in cable 47 to effect movement of the bucket 43 towards the base frame 14.

If desired, the boom 30 may be mounted off centre of the axis L of the vehicle, in which case the operator's cab 21 and superstructure 22 could be provided in alternative positions.

The counterweight 20*a*, need not move on a guide path comprising longitudinal members 18*a* and 18*b* on rollers 19 as described, but any other means to effect movement of counterweight 20*a*, or more or less than two counterweights as the centre of gravity of the machine changes, towards and away from vertical axis V, may be provided.

We claim:

1. A machine comprising a body having a ground engaging propulsion means, a base frame, means mounting the base frame on the ground engaging propulsion means for movement relative to the ground engaging propulsion means about a first generally vertical axis, a boom extending outwardly of the body, means mounting the boom on the base frame for movement about a second axis transverse to the first axis, a dipper arm, means mounting the dipper arm at an outer end of the boom for movement about a third axis also transverse to the first vertical axis, an implement, means mounting the implement at an outer end of the dipper arm for movement about a fourth axis, also generally transverse relative to the first vertical axis, a cable, means securing the cable to the dipper arm, a winch means, means connecting the cable to the winch means to enable movement of the dipper arm relative to the boom and hence to effect movement of the implement towards the body, a hydraulic ram, means mounting the hydraulic ram between the dipper arm and the boom to effect movement of the dipper arm relative to the boom and hence to effect movement of the implement at least away from the body, a counterweight, means mounting the counterweight on the base frame, and means for moving the counterweight towards and away from the first vertical axis in response to movement of the centre of gravity of the machine.

2. A machine according to claim 1 wherein movement of the counterweight is along an axis generally perpendicular to the first vertical axis.

3. A machine according to claim 1 wherein an operator's cab is mounted on one side of the base frame, from which an operator may control the operation of the hydraulic ram and the winch means.

4. A machine according to claim 1 additionally including an operating member for moving the counterweight towards and away from the first vertical axis of the machine in proportion to the degree of movement of the dipper arm relative to the boom, and wherein a sensor is provided to sense any change in relative position between the dipper arm and the boom, the sensor sending a signal to said operating member to effect said counterweight movement.

5. A machine according to claim 4 wherein the sensor comprises a hydraulic sensor and the operating member comprises an hydraulic operating member, the signal comprising the passage of hydraulic fluid from the sensor towards the operating member which moves the counterweight.

6. A machine according to claim 4 wherein a further hydraulic ram connected to the boom is provided to permit movement of the boom relative to the body about the second transverse axis, and the sensor comprises an hydraulic sensor which senses changes in pressure within the further hydraulic ram caused by movement of the dipper arm relative to the boom.

7. A machine according to claim 4 wherein the operating member comprises a hydraulic motor which is operatively connected to a lead screw, the screw being fixed relative to the counterweight such that as the screw is rotated by the hydraulic motor in response to the signal, the counterweight is moved towards or away from the first axis.

8. A machine according to claim 1 wherein the boom is mounted adjacent its end to the body of the machine, so that no significant part of the boom extends rearwardly of the mounting, the boom comprising a single boom part which is curved intermediate its ends.

9. A machine according to claim 1 wherein the machine is an earth moving machine, the implement comprising an excavating implement mounted on the dipper arm such that the implement is filled as the implement moves towards the body of the machine.

10. A machine according to claim 1 wherein the second, third and fourth axes are each generally perpendicular to the first vertical axis.

11. A machine comprising a body having a ground engaging propulsion means, a base frame, means mounting the base frame on the ground engaging propulsion means for movement relative to the ground engaging propulsion means about a first generally vertical axis, a boom extending outwardly of the body, means mounting the boom on the base frame for movement about a second axis transverse to the first axis, a dipper arm, means mounting the dipper arm at an outer end of the boom for movement about a third axis also transverse to the first vertical axis, an implement, means mounting the implement at an outer end of the dipper arm for movement about a fourth axis, also generally transverse relative to the first vertical axis, a cable, means securing the cable to the dipper arm, a winch means, means connecting the cable to the winch means to enable movement of the dipper arm relative to the boom and hence to effect movement of the implement towards the body, a hydraulic ram, means mounting the hydraulic ram between the dipper arm and the boom to effect movement of the dipper arm relative to the boom and hence to effect movement of the implement at least away from the body, a counterweight, means mounting the counterweight on the base frame, means for moving the counterweight towards and away from the first vertical axis in response to movement of the centre of gravity of the machine, said machine additionally including an operating member for moving the counterweight towards and away from the first vertical axis of the machine in proportion to the degree of movement of the dipper arm relative to the boom, and wherein a sensor is provided to sense any change in relative position between the dipper arm and the boom, the sensor sending a signal to said operating member to effect said counterweight movement.

12. A machine according to claim 11 wherein the sensor comprises an hydraulic sensor and the operating member comprises an hydraulic operating member, the signal comprising the passage of hydraulic fluid from the sensor towards the operating member which moves the counterweight.

13. A machine according to claim 11 wherein a further hydraulic ram connected to the boom is provided to permit movement of the boom relative to the body about the second transverse axis, and the sensor comprises a hydraulic sensor which senses changes in pressure within the further hydraulic ram caused by movement of the dipper arm relative to the boom.

14. A machine according to claim 11 wherein the operating machine comprises a hydraulic motor which is operatively connected to a lead screw, the screw being fixed relative to the counterweight such that as the screw is rotated by the hydraulic motor in response to the signal, the counterweight is moved towards or away from the first axis.

* * * * *